United States Patent [19]

Nilsen

[11] 4,023,959

[45] May 17, 1977

[54] METHOD FOR RECOVERING VANADIUM FROM MAGNETITE AND FORMING A MAGNETITE PRODUCT LOW IN SODIUM AND SILICA

[75] Inventor: Arnold Earl Nilsen, Freehold, N.J.

[73] Assignee: NL Industries, Inc., New York, N.Y.

[22] Filed: Apr. 5, 1976

[21] Appl. No.: 673,716

[52] U.S. Cl. ..... 75/1 R; 75/1 T; 423/62; 423/150

[51] Int. Cl.[2] ..... C22B 1/00

[58] Field of Search ..... 75/.5 AA, .5 BA, .5 AB, 75/.5 BB, 1 R, 1 TI; 423/62, 150

[56] References Cited

UNITED STATES PATENTS

| | | | |
|---|---|---|---|
| 3,597,153 | 8/1971 | Atmore et al. | 423/62 |
| 3,733,193 | 5/1973 | Fox et al. | 75/1 T |

*Primary Examiner*—W. Stallard

[57] ABSTRACT

Magnetite concentrate comprising essentially iron oxide as $Fe_3O_4$, titanium dioxide and lesser amounts of vanadium and silicious materials is screened and treated with relatively small amounts of sodium to recover from 70 to 90% of the vanadium and at the same time produce a magnetite end-product suitable as feed material for blast furnaces, said end-product containing as low as about 0.3% sodium as $Na_2O$ and as low as 1.0% $SiO_2$.

11 Claims, No Drawings

METHOD FOR RECOVERING VANADIUM FROM MAGNETITE AND FORMING A MAGNETITE PRODUCT LOW IN SODIUM AND SILICA

BACKGROUND OF INVENTION

Ilmenite is commonly used as source material for the production of pigmentary titanium dioxide and is found in massive deposits of ilmenite-magnetite in the Adirondack Mountains of New York. As mined, the ore may contain about 32% ilmenite and 35% magnetite with lesser amounts of other materials such as feldspar, garnet, hornblende and the like, these latter materials being sometimes hereinafter referred to generically as silicious materials. The magnetite portion of the ore also contains appreciable amounts of vanadium. A magnetite concentrate comprising essentially iron oxide as $Fe_3O_4$, some silicious material and relatively high levels of vanadium is obtained by processing the ilmenite-magnetite ore in successive grinding and wet-magnetic separation operations an ilmenite concentrate being recovered from the non-magnetic tailings by hydraulic classifiers and tables.

The magnetite concentrate so obtained may comprise as high as 65% iron as $Fe_3O_4$ and 0.5% vanadium. This concentrate has been treated by the well-known soda-roast method to recover the vanadium. However, the recovered iron is unsuitable as blast furnace feed because of high soda (sodium) contamination.

U.S. Pat. No. 3,615,342 is of interest in that it refers to a soda-roast leaching process for removing non-ferrous metal values including vanadium from iron ore concentrate wherein the iron ore is mixed with soda ash and the mixture formed into pellets which are roasted and then leached to recover the vanadium values as a water soluble sodium-vanadium compound. However, as the patentee points out, the leached pellets so formed include relatively high levels of sodium and hence are unsuitable for use as feed material in blast furnaces; the gist of the invention being reduction in the amount of sodium in the pellets by soaking the pellets in an aqueous solution of calcium chloride for protracted periods of time at 176° F. and then elevating the temperature to as high as 235° F. to remove the sodium values.

U.S. Pat. No. 3,733,193 relates to a technique for recovering vanadium as sodium vanadate from ores such as magnetide using high levels of soda ash, i.e. from 10 to 20%; with or without from 2–15% $Al_2O_3$. This patent is, however, concerned only with the percent recovery of vanadium as sodium vanadate from the magnetite and not with the composition of the residual iron oxide product as feed material for blast furnaces in the production of metallic iron.

SUMMARY OF INVENTION

The present invention is the discovery of a new and improved process for treating iron-containing ores and in particular magnetite concentrates containing silicious materials and vanadium in a manner to recover a major portion of the vanadium values and at the same time form a magnetite end-product substantially free of sodium and silicious materials and hence ideally suited as feed material for blast furnaces; the process being characterized by milling a magnetite concentrate, and then screening the concentrate thereby separating a finely divided magnetite fraction from a relatively coarse silicious fraction. The finely divided magnetite fraction, which now contains from 1.1 to no more than about 1.7% silica, is then mixed with a sodium compound in amounts no more than about 1.0 to 1.75%, on magnetite weight basis, followed by roasting and leaching to recover from 70 to 90% of the vanadium values as a sodium-vanadium solution which is subsequently converted to sodium vanadate. The magnetite end-product recovered will be found to comprise no more than about 1.0% $SiO_2$ and as low as about 0.3% $Na_2O$ at which levels the magnetite may be used successfully, without further treatment, as feed material for blast furnaces in the production of metallic iron.

PREFERRED EMBODIMENT OF INVENTION

Magnetite concentrates are prepared from ilmenite-magnetite ores by first grinding the ore and then affecting an initial separation of the magnetite from the ilmenite fraction by wet magnetic separation methods after which the magnetite fraction is again ground to 70–90% -325 mesh and the gangue material separated therefrom thereby forming a magnetite concentrate of from 65 to 91% $Fe_3O_4$. It has now been discovered that despite the previous grinding and separation steps the magnetite concentrate will comprise two distinct fractions, the one being an appreciable amount of relatively coarse silicious material and the other fine magnetite; and that by screening the concentrate on +250 to +270 mesh screens the coarse silica can be separated from the magnetite fraction to a level as low as about 1.1% $SiO_2$ with only about a 5% loss of magnetite; and that because of this low level of silica the addition of unexpectedly small amounts of sodium, that is to say, from 0.43 to 0.75% sodium as $Na_2CO_3$ which is equivalent to from 1.0 to no more than about 1.75% $Na_2CO_3$, (as denoted in the Tables below) will suffice to affect relatively high recoveries of vanadium from the magnetite. To this end the mixture of screened magnetite concentrate and sodium compound is roasted at a temperature in the range from 1000° to 1300° C. for from 1 to 2 hours to oxidize the vanadium values to the five valence state at which valence the vanadium reacts with the sodium compound to form a water soluble sodium vanadate. The roasted mixture is then cooled and subjected to a water leach whereby from 70 to 90% of the vanadium is recovered. The water-leached magnetite end-product will be found to contain only about 0.3% sodium as $Na_2O$ and no more than about 1.0% $SiO_2$. While not essential, it is preferred that the mixture of screened magnetite concentrate and sodium compound be formed into pellets prior to roasting; which pellets, following roasting and leaching, will be strong enough to be handled without breakage and have no deleterious effect on the refractory linings of blast furnaces.

As a modification of the above procedure the screened magnetite concentrate may be mixed with a compound of sodium such as for example soda ash ($Na_2CO_3$) plus a small amount of an aluminum compound, as for example from 0.3 to 0.75% $Al_2O_3$. The addition of the alumina modifies the slag-forming constituants in the magnetite during roasting to raise their melting point thereby decreasing the tendency for fusion. As a consequence, the pellets remain more porous and oxidize more completely which is essential to vanadium extraction; and being more porous the extraction of vanadium, as soluble sodium vanadate, by leaching is increased. Thus, for example, when 1.0% $Na_2CO_3$ is used alone vanadium recoveries may be as low as 69% whereas by adding 0.3% $Al_2O_3$ vanadium recoveries will be increased to as high as 77%.

The leached liquor recovered in the leaching step consists essentially of soluble sodium vanadate from which the vanadium values are extracted in known manner by adding ammonium chloride to the filtrate, heating the mixture and thereafter adding sulfuric acid in an amount to lower the pH of the filtrate from about 14 to about 2 to precipitate hydrolyzed ammonium polyvanadate. It is, of course, essential to the formation of the hydrolyzed ammonium polyvanadate that the ratio of vanadium to $Na_2O$ in solution be greater than 1:4. Any sodium present in the filtrate reacts with the $H_2SO_4$ to form sodium sulfate which must be disposed of. Hence, by screening the magnetite less ammonia is required and hence less $Na_2SO_4$ formed for disposal.

The invention is comprehensive of sodium compounds other than soda ash as for example sodium hydroxide, sodium chloride and sodium sulfate.

The following examples will further illustrate the invention.

The magnetite concentrates used in the examples below were derived from massive magnetite-ilmenite ores mined at Tahawas, New York State, by process as hereinabove described. Two different concentrates were used the one, as in Examples 1 and 9, comprising essentially 87% $Fe_3O_4$, 5.0% $TiO_2$, 1.5% $SiO_2$ and 1.7% $V_2O_5$; the other concentrate comprising essentially 91% $Fe_3O_4$, 2.4% $TiO_2$, 1.7% $SiO_2$ and 2.0% $V_2O_5$. Each of these ore concentrates was screened on a +250 mesh screen to separate additional silicious materials from the finely divided magnetite. Since a high proportion of the silicious materials occur in the coarser fraction (+250 mesh) the level of $SiO_2$ in the screened concentrates was reduced to as low as 1.1% and with no more than about 5% removal of magnetite. Using this screened magnetite concentrate a series of runs were made using mixtures of the magnetite and varying amounts of sodium or sodium and aluminum compounds. These mixtures were pelletized by means of a drum pelletizer and then roasted at elevated temperatures for various periods of time after which the pelletized products were water leached to recover the vanadium values. The leached pellets were then analyzed for sodium content.

EXAMPLE I

To a screened magnetite concentrate of the composition hereinabove described was added 0.43% sodium as $Na_2CO_3$ or 1.0% $Na_2CO_3$ on a weight basis and mixed thoroughly. The mixture was than pelletized by a drum pelletizer and the pellets fired at a temperature of 1300° C. for 2 hours. The pellets were then cooled and leached with water to recover the vanadium values. Substantially 69% of the vanadium in the original screened magnetite concentrate was recovered as soluble sodium vanadate. The pellets were then tested for sodium content and found to contain as little as 0.35% $Na_2O$ and 1.1% $SiO_2$. The pellets were hard and hence could be handled without breaking and at these low levels of sodium and silica were ideally suited as feed material for blast furnace operations.

EXAMPLES II – IX

An additional series of runs were made using the procedure of Example I but with sodium compounds alone or in combination with alumina. The data for these runs and the results are shown in the Table below.

TABLE I

| Exp. | Additive | Amount Additive (%) | $Al_2O_3$ (%) | Temp. (Roast) | Time (Hrs.) | Recovered (%) | Sodium in Pellet(%) |
|---|---|---|---|---|---|---|---|
| 1 | $Na_2CO_3$ | 1.0 | 0.0 | 1300° C. | 1 | 69 | 0.35 |
| 2 | " | " | 0.3 | " | " | 77 | 0.39 |
| 3 | $NaCO_3$ | 1.25 | 0.5 | 1300° C. | 1 | 83 | 0.46 |
| 4 | " | " | 0.75 | " | " | 81 | 0.43 |
| 5 | $NaCO_3$ | 1.50 | 0.0 | 1300° C. | 1 | 86 | 0.53 |
| 6 | " | " | 0.5 | " | " | 90 | 0.47 |
| 7 | $Na_2CO_3$ | 1.75 | 0.0 | 1300° C. | 1 | 85 | 0.50 |
| 8 | " | " | 0.5 | " | " | 91 | 0.42 |
| 9 | NaOH | 1.0 | 0.0 | 1300° C. | 1 | 79 | 0.36 |

Table II below compares the amounts of sodium ($Na_2O$) in the processed magnetite pellets using magnetite concentrates having varying amounts of silica pursuant to the experiments of Table I above.

TABLE II

| Silica (%) | $NaCO_3$ Added (%) | $Al_2O_3$ Added (%) | V (Recovery) | $Na_2O$ in Pellets (%) |
|---|---|---|---|---|
| 1.7 | 3.0 | 0.0 | 85 | 0.9 |
| 1.1 | 1.5 | 0.0 | 86 | 0.53 |
| 1.1 | 1.25 | 0.5 | 83 | 0.46 |
| 1.1 | 1.50 | 0.5 | 90 | 0.47 |
| 1.1 | 1.75 | 0.5 | 91 | 0.42 |

Thus it will be seen that when the silica in the magnetite concentrate is lowered, by screening, from 1.7% to 1.1% the amount of soda ash required, in the absence of $Al_2O_3$, for effecting comparable levels of vanadium recovery i.e. 85 to 86%, is substantially 50% less; and the amount of $Na_2O$ contamination in the pelletized magnetite about 42% less (Example II) — than is the case with the unscreened magnetite concentrate of Example 10; and that with the addition of 0.5% $Al_2O_3$, Example 13, vanadium recoveries are increased to 90% with only about 0.47% $Na_2O$ in the pellets.

From the foregoing description and examples it is clear that the instant invention relates to an improved process for recovering high percentages of vanadium from magnetite concentrates and at the same time producing a magnetite end-product which is sufficiently low in sodium that it may be used, without further treatment as blast furnace feed material for production of metallic iron, the gist of the invention being the discovery that by screening a magnetite concentrate on +250 to +270 mesh screens substantially all of the relatively coarse silicious materials can be separated from the finely divided magnetite as a consequence of which relatively low levels of sodium will suffice to recover from 70 to 90% of the vanadium from the magnetite with as low as about 0.3% sodium and as low as 1.0% $SiO_2$ in the magnetite end-product.

While the invention has been described and illustrated by the examples included herein it is not intended that the invention be strictly limited thereto and other variations and modifications may be employed within the scope of the appended claims.

I claim:

1. Process for recovering vanadium from magnetite and producing a magnetite end product suitable for use as feed material for blast furnaces in the production of metallic iron comprising: preparing a finely divided magnetite concentrate consisting essentially of iron oxide as $Fe_3O_4$, titanium dioxide and minor amounts of silicious materials and vanadium, screening said magnetite concentrate on +250 to +270 screens thereby separating a finely divided magnetite fraction from a coarser silicious fraction, admixing a sodium compound with said screened, finely divided magnetite fraction, said sodium compound added in amount equivalent to 0.43–0.75% sodium on magnetite weight basis, roasting the mixture at temperature in the range from 1000° to 1300° C. for from 1 to 2 hours to convert the vanadium values in said magnetite to a water soluble sodiumvanadium compound, and leaching the roasted magnetite-sodium mixture with water to dissolve and remove the sodium-vanadium compound therefrom and produce a magnetite product containing as low as about 0.3% sodium and no more than about 1.0% $SiO_2$.

2. Process for producing a magnetite end product according to claim 1 wherein said sodium compound is soda ash added in amount from about 1.0 to about 1.75% on magnetite weight basis.

3. Process for producing a magnetite end product according to claim 2 wherein the mixture of said soda ash and finely divided magnetite is pelletized prior to roasting.

4. Process for producing a magnetite end product according to claim 1 wherein alumina is admixed with the sodium compound and the finely divided magnetite fraction, said sodium compound added in amount from about 1.0% to about 1.75% and said alumina in amount from 0.3 to about 0.5% on magnetite weight basis.

5. A magnetite end product produced according to the method of claim 1 wherein said magnetite product consists essentially of iron oxide as $Fe_3O_4$, no more than about 1.0% silica and as low as about 0.3% sodium.

6. In a process for producing a magnetite feed material for blast furnace operations in the production of metallic iron wherein a magnetite concentrate is mixed with a compound of sodium which mixture is roasted to form a water-soluble sodium-vanadium compound which, in turn, is leached with water to dissolve and remove the vanadium values therefrom, the improvement comprising: screening the magnetite concentrate on +250 to +270 screens thereby separating a finely divided magnetite fraction from a relatively coarse silicious fraction, admixing a sodium compound with the finely divided magnetite fraction said sodium compound added in amount equivalent to 0.43 to no more than 0.75% sodium on magnetite weight basis, roasting the mixture at temperature in the range from 1000° to 1300° C. for from 1 to 2 hours to convert the vanadium values in said magnetite to a water-soluble sodium-vanadium compound, and leaching the roasted magnetite-sodium mixture with water to dissolve and remove the sodium-vanadium compound therefrom and produce a magnetite feed material substantially free of vanadium, sodium and $SiO_2$.

7. In a process for producing a magnetite feed material according to claim 6 wherein the sodium compound is soda ash added in an amount from 1.0 to about 1.75% on magnetite weight basis.

8. In a process for producing a magnetite feed material according to claim 7 wherein the mixture of soda ash and finely divided magnetite is pelletized prior to roasting.

9. In a process for producing a magnetite feed material according to claim 6 wherein alumina is admixed with the sodium compound and said finely divided magnetite fraction said sodium compound added in amount from 1.0% to no more than 1.75% and said alumina in amount from 0.3% to 0.5% on magnetite weight basis.

10. A magnetite product suitable for use as feed material for blast furnaces in the production of metallic iron said magnetite product consisting essentially of iron oxide as $Fe_3O_4$, as low as about 0.3% sodium and no more than about 1.0% $SiO_2$.

11. Process for producing a magnetite end product according to claim 1 wherein said sodium compound is sodium hydroxide added in an amount of about 1.0% on magnetite weight basis.

* * * * *